US007344404B2

(12) United States Patent
Wilinski

(10) Patent No.: US 7,344,404 B2
(45) Date of Patent: Mar. 18, 2008

(54) ELECTRICAL CONNECTING DEVICE

(75) Inventor: Bernd Wilinski, Lemgo (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/463,173

(22) Filed: Aug. 8, 2006

(65) Prior Publication Data

US 2007/0054541 A1 Mar. 8, 2007

(30) Foreign Application Priority Data

Aug. 11, 2005 (DE) ..... 20 2005 012 792 U

(51) Int. Cl.
*H01R 4/24* (2006.01)

(52) U.S. Cl. ..... 439/409

(58) Field of Classification Search ..... 439/409, 439/410, 406, 417

See application file for complete search history.

(56) References Cited

U.S. PATENT DOCUMENTS 3,078,434 A * 2/1963 Pohl ..... 439/409
3,757,281 A * 9/1973 Woertz et al. ..... 439/724
3,816,819 A * 6/1974 Judd ..... 439/409
3,960,431 A * 6/1976 MacKenzie et al. ..... 439/399
4,340,270 A * 7/1982 Wilmes et al. ..... 439/397
4,729,738 A * 3/1988 Heng et al. ..... 439/395
5,041,013 A * 8/1991 Greenbaum ..... 439/425
6,120,315 A * 9/2000 Gaertner et al. ..... 439/395
6,500,021 B2 * 12/2002 Wilmes et al. ..... 439/409
6,863,558 B2 * 3/2005 Negishi et al. ..... 439/404
7,048,571 B2 5/2006 Wilinski

FOREIGN PATENT DOCUMENTS

DE 199 21 775 A1 11/2000
DE 203 12 123 U1 11/2003

* cited by examiner

*Primary Examiner*—Tulsidas C. Patel
*Assistant Examiner*—Vladimir Imas
(74) *Attorney, Agent, or Firm*—David S. Safran

(57) ABSTRACT

An electrical connecting device with a housing, with terminals for insulated conductors, with at least one conductor bar, with at least two actuating elements and with at least two insulation piercing elements, the actuating elements being arranged to be able to turn relative to the insulation piercing elements and each having a conductor receiver for the conductors to be connected. The insulation piercing elements establish electrical contact of a conductor which has been inserted into the conductor receiver to the conductor bar, when the actuating element is pivoted out of a first position, in which the conductor can be inserted into the conductor receiver into a second position. By the conductor receiver being able to have at least two insulated conductors can be inserted therein, the possible applications are further enhanced, and the dimensions of the connecting device can be as small as possible.

14 Claims, 5 Drawing Sheets

ELECTRICAL CONNECTING DEVICE

BACKGROUND OF THE INVENTION

1. Field of the Invention

The invention relates to an electrical connecting device with insulation piercing technology, with a housing, with terminals for insulated conductors, with at least one conductor bar, with at least two actuating elements and with at least two insulation piercing elements, the actuating elements being arranged to be able to turn relative to the insulation piercing elements in the electrical connecting device and each having a conductor receiver for the conductors to be connected, and the insulation piercing elements establishing electrical contact of a conductor inserted into the conductor receiver to the conductor bar, when an actuating element is pivoted out of a first position in which the conductor can be inserted into the conductor receiver (insertion position) into a second position (contact position).

2. Description of Related Art

Electrical connecting devices, especially modular connecting devices, have been known for decades and are being used in the millions in the wiring of electrical systems and devices. The connecting devices are generally locked onto mounting rails which, for their part, with multiple connecting devices often being located in a control cabinet. The connecting devices are generally made as connecting terminals so that they have at least two conductor terminal elements which are electrically connected to one another via an electrically conductive connecting bar. In addition to this basic type of modular connecting device, there is also a host of different types of modular connecting devices which are especially adapted to the respective applications. Examples are two-tier or three-tier connecting devices and two-wire or four-wire connecting devices each of which have a correspondingly large number of conductor terminal elements.

Conductor terminal elements in modular connecting devices are largely screw terminals or tension spring terminals. The clamping principle in tension spring terminals is similar to that of screw technology. While in the screw terminal a tension sleeve pulls the conductor against the conductor bar by actuating a clamping screw, in a tension spring terminal this task is performed by the tension spring. To do this, the pretensioned tension spring is opened with an actuating tool, for example, a screw driver, so that the conductor can be inserted through a window in the spring leg of the tension spring into the terminal space. After removing the actuating tool, the conductor is pulled by the spring force of the tension spring against the conductor bar.

Both in the screw terminal and also in the tension spring terminal, the electrical conductor must first be stripped after it is cut to length before contact can be made with the electrical terminal. Since a special tool is necessary for stripping the electrical conductors, and since stripping is relatively time-consuming, for many years, electrical connecting devices have also been used to which electrical conductors can be connected without prior stripping. To do this, the insulated conductor is inserted into a conductor receiver in the housing of the connecting device, and then, is pressed into an insulation piercing element, by which the insulation of the conductor is cut through and contact is made with the core of the conductor by the insulation piercing elements. In this case, there is a host of possible versions of these connecting devices for connecting unstripped conductors. They differ especially in how the conductor inserted into the conductor receiver is pressed into the insulation piercing element and by the specific configuration of the insulation piercing element which, in addition to making contact with the core of the conductor, also clamps the insulation, and thus, the conductor altogether.

The initially described electrical connecting device in insulation piercing technology is known, for example, from German Patent Application DE 199 21 775 A1. For this known connecting terminal unit, the actuating elements are supported by means of relatively large, wheel-like guides in a pivoting support formed by the housing side wall. Because the actuating elements are pivotally supported directly in the side wall of the housing, a maximum diameter is available for the conductor to be connected. Thus, for a given conductor cross section, the width of the electrical connecting device can be chosen to be relatively small. However, the wheel-like guide of the actuating elements in the side wall has the disadvantage that problems can arise in adherence to the required creepage distances, and thus, insulation problems can occur.

German Utility Model DE 203 12 123 U1 and German Patent Application DE 103 47 668 A1 (corresponding to U.S. Pat. No. 7,048,571) disclose electrical connecting devices in insulation piercing technology which, in addition to a conductor bar with insulation piercing elements on its ends, has at least two actuating elements pivotally arranged in the housing. The actuating elements are supported in the housing by means of journals which are made on their side surface and which are guided in the corresponding openings in the side wall of the housing. These electrical connecting devices, especially modular connecting devices, have proven themselves in practice due to their simple structure and their easy and safe handling. Therefore, it is desirable to further increase the possible applications of these electrical connecting devices, and the dimensions of the connecting devices are to be kept as small as possible.

SUMMARY OF THE INVENTION

A primary object of the electrical connecting device of the present invention is achieved by the conductor receiver in the actuating elements being made such that at least two insulated conductors can be inserted into the conductor receiver. This makes it possible especially easily without significantly increasing the dimensions of the electrical connecting device to connect twice the number of insulated conductors to the connecting device.

Basically, there are various possibilities for how the conductor receiver is specifically made in the actuating elements. Preferably, the conductor receiver is made such that two insulated conductors can be inserted in succession into the conductor receiver in the lengthwise direction of the connecting device. In this way, on the one hand, widening of the electrical connecting device is prevented, and on the other hand, the pivoting of the actuating element out of the first position in which the incoming conductors can be inserted (insertion position) into the second position in which contact with the conductors is made by the insulation piercing element (contact position) is only slightly more complex, since the two insulated conductors are inserted when pivoted in succession between the two cutting edges of the insulation piercing element.

To insert at least two insulated conductors at a time into the actuating elements, the conductor receiver, according to a preferred version of the invention, has an oblong cross section. However, basically, it is also possible to make two separate, successively arranged conductor receivers in each actuating element. However, by forming only one conductor receiver with an oblong cross section, the dimensions of the actuating elements, and thus, also the electrical connecting device can be further reduced.

The actuating elements in the housing of the electric connecting device can be supported in different, recognized ways. According to a first embodiment, the actuating elements are pivotally supported by means of a journal made on at least one side surface in a corresponding opening in the side wall of the housing. In this connection the actuating elements can be additionally supported with parts of their arc-shaped front sides on the corresponding support surfaces within the housing.

For simple handling of the electrical connecting device, the actuating element according to a preferred version of the electrical connecting device in accordance with the invention can be latched both in a first position (insertion position) and also in a second position (contact position). To do this, on at least one side surface of the actuating element, there is a locking journal located off-center which can lock in the insertion position in a first catch opening which is made in the side wall of the housing and in the contact position in the second catch opening. This makes it possible to fix the electrical connecting device in a first position, the insertion position, when delivered to the customer, so that when individual electrical conductors are connected to a plurality of electrical connecting devices locked next to one another on a mounting rail, the respective conductors can be easily inserted by the electrician into the respective conductor receivers. The possibility of locking in the second position, the contact position, prevents an electrical conductor, once connected, from being unintentionally pulled out of the electrical connecting device again.

Advantageously, the two catch openings made in the side wall of the housing are connected to one another by a slot. The slot enables simple—intentional—pivoting of the actuating element out of the first position into the second position and vice versa. The slot is used here as a guide for a locking journal and the width of the slot should be chosen to be somewhat smaller than the diameter of the locking journal. This ensures that the actuating element cannot unintentionally pivot out of the first position into the second position. However, at the same time, intentional pivoting of the actuating element out of the first position into the second position is associated with only a slight expenditure of force, since the slot can be easily widened to the required width due to the elasticity of the side wall of the housing.

According to an alternative version, the actuating elements are supported by two journals being made on at least one side surface of the actuating element and two corresponding oblong holes being made in at least one side wall of the housing, the two oblong holes lying on a common circular path and being spaced apart from one another. The interaction of the two journals with the two oblong holes that are spaced apart from one another in the side wall of the housing yields not only support for the actuating element during pivoting, as is the case for the journal, but, at the same time, also limitation of the maximum possible rotation or tilting of the actuating element.

Finally, in the electric connecting device in accordance with the invention, it is provided that the actuating elements each have a receiver for engaging a device, for example, the tip of a screwdriver so that, using the screwdriver, the electrical connecting device or actuating element can be easily pivoted from the first position (insertion position) into the second position (contact position).

In particular, there are a host of possibilities for embodying and developing the electrical terminal in accordance with the invention. In this respect reference is made to the description of preferred embodiments in conjunction with the drawings.

DETAILED DESCRIPTION OF THE INVENTION

Figure 1:
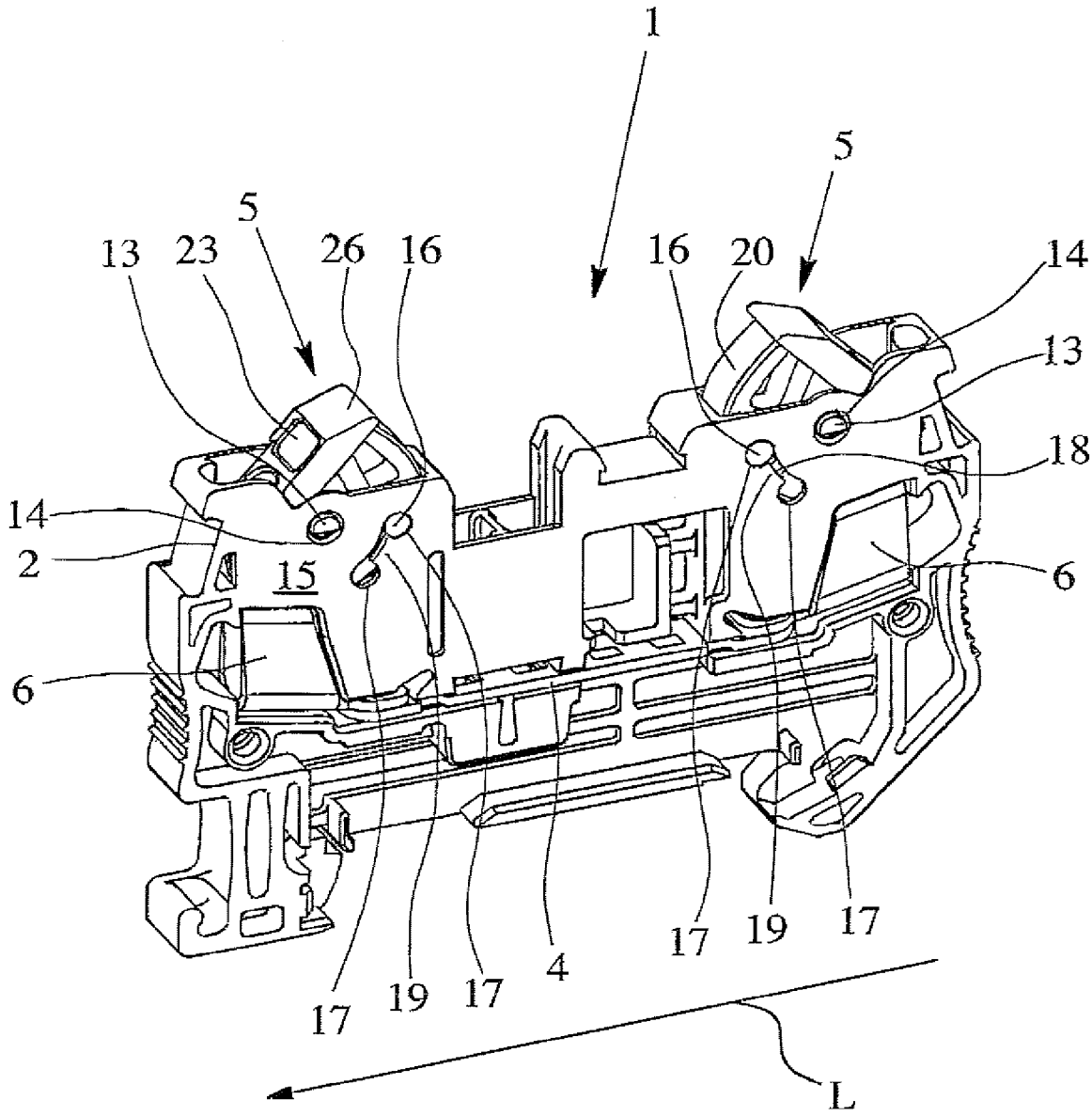
FIG. 1 is a perspective of an electrical connecting device.
Figure 2A:
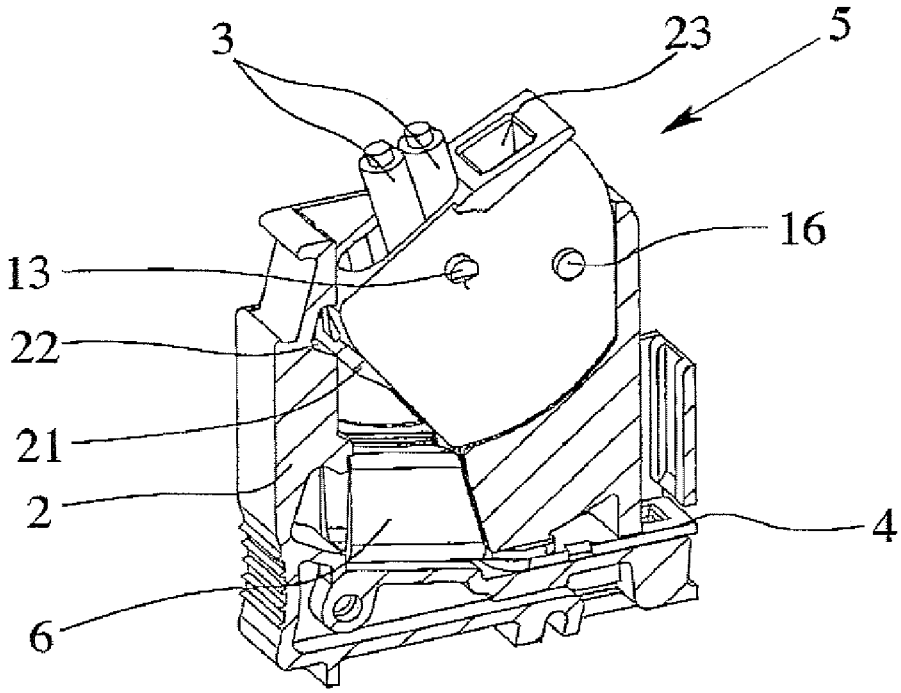
FIGS. 2*a* & 2*b* are two views of part of a first version of an electrical connecting device in accordance with the invention with the side wall omitted, in the first position and in the second position, respectively.

The electrical connecting device 1 which is shown in its entirety only in FIG. 1 comprises, first of all, a housing 2, with terminals for the incoming, insulated conductors 3 shown in FIGS. 2 & 3. Using the correspondingly made foot of the housing 2, the electrical connecting device 1 can be locked onto a mounting rail (not shown). A conductor bar 4 and two actuating elements 5 are located in the housing 2 of the electrical connecting device 1. Moreover, the electrical connecting device 1 has two insulation piercing elements 6 which are mechanically and electrically connected to the conductor rail 4 and which are electrically connected to one another via the conductor bar 4, so that the electrical connecting device 1 shown in FIG. 1 is a connecting terminal unit.

Figure 3A:
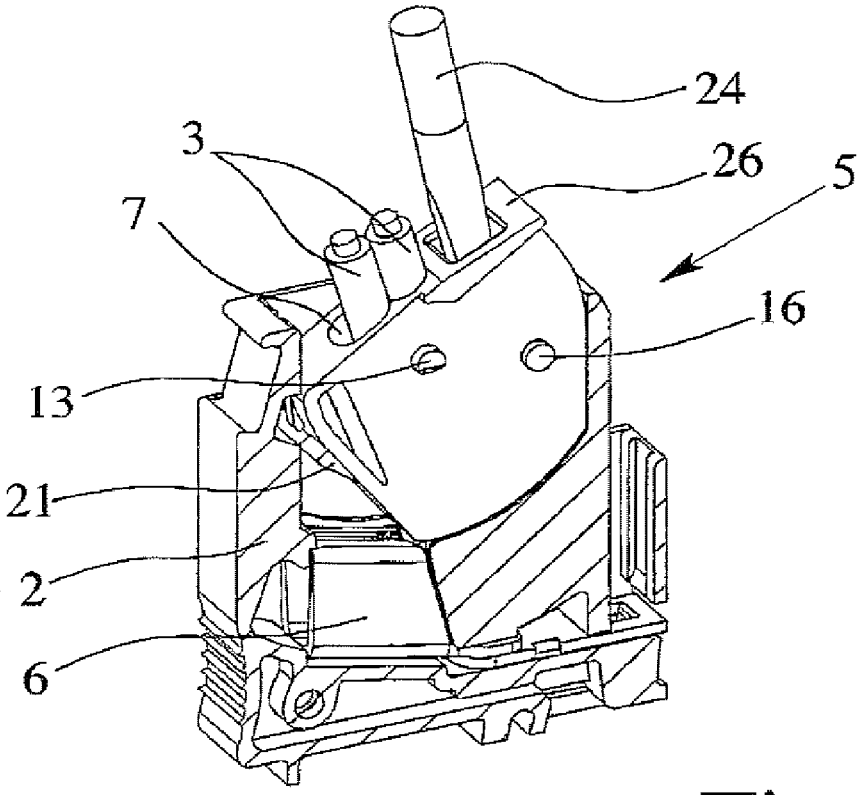
FIGS. 3*a* & 3*b* are two views of part of a second version of an electrical connecting device in accordance with the invention with the side wall omitted, in the first position and in the second position, respectively.
Figure 3B:
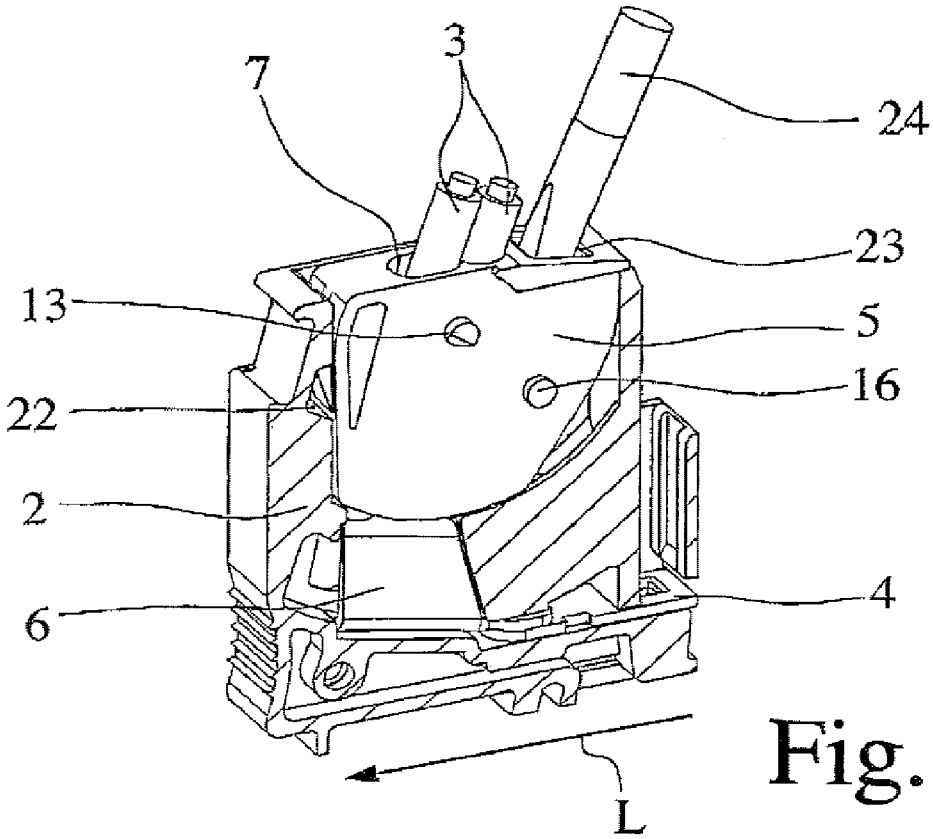
Figure 4:
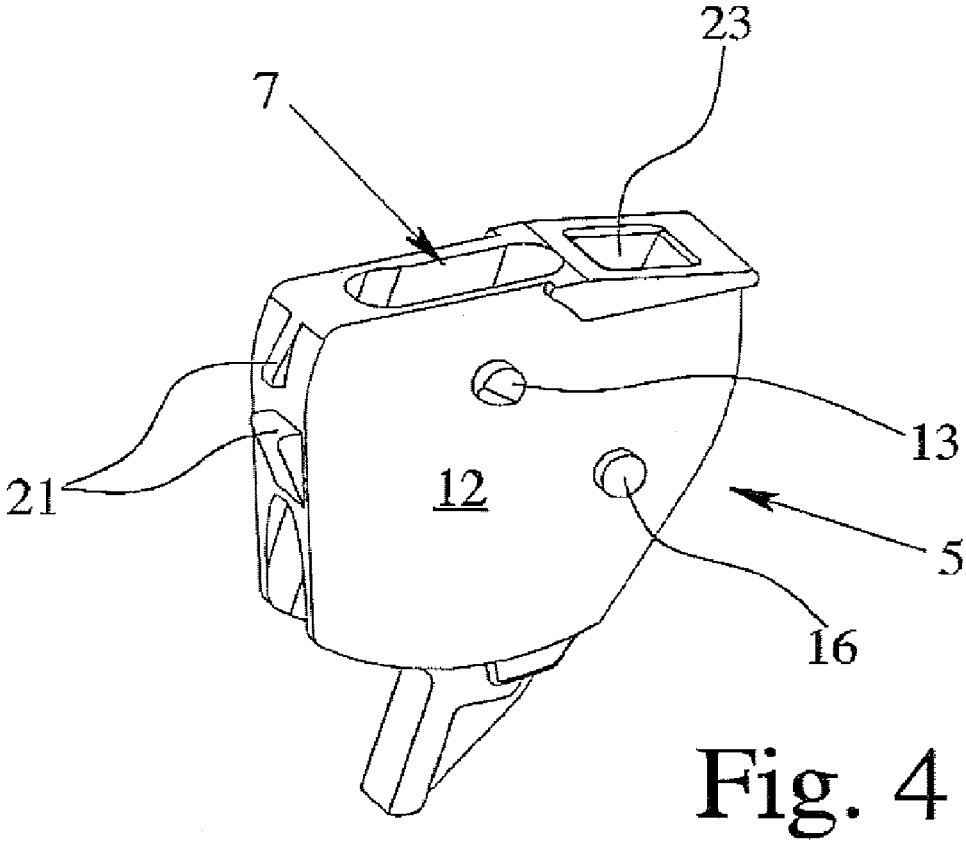
FIG. 4 is an enlarged view of an actuating element of the embodiment shown in FIGS. 2*a* & 2*b*.
Figure 5:
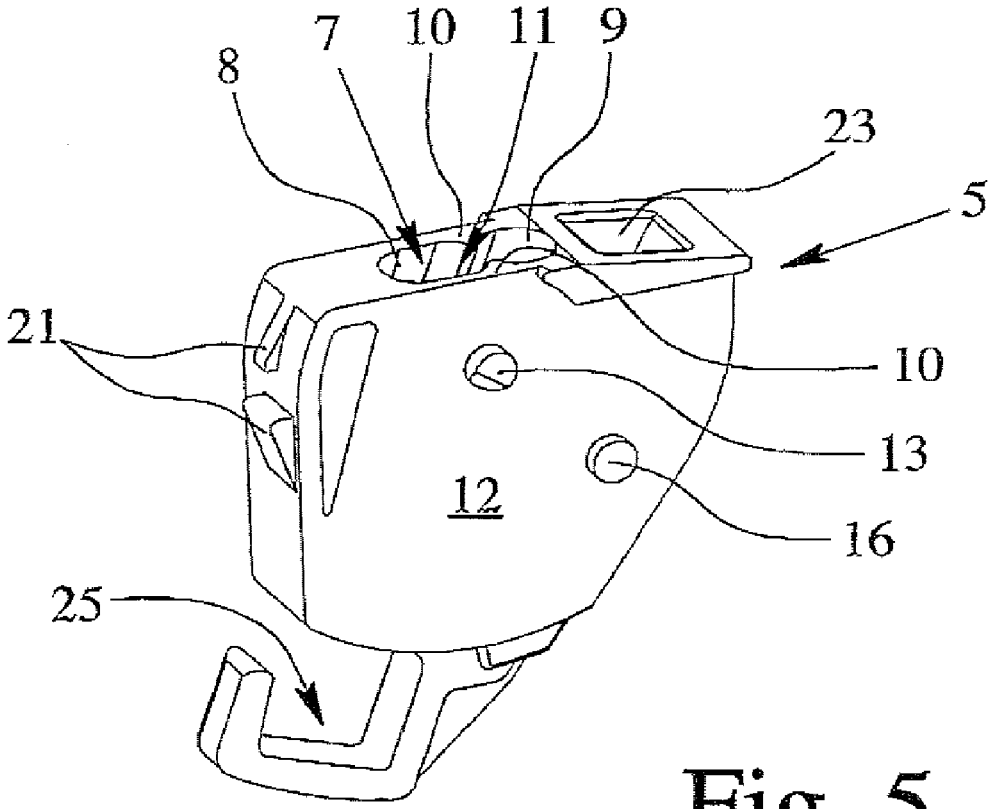
FIG. 5 is an enlarged view of an actuating element of the embodiment shown in FIGS. 3*a* & 3*b*, and FIGS. 6*a* & 6*b* are two sectional views of part of a first version of an electrical connecting device in accordance with the invention as shown in FIG. 2, in two different positions.

The actuating elements 5, of which two embodiments are shown separately in FIGS. 4 and 5, each have one conductor receiver 7 for the insulated conductors 3 to be connected. Because the actuating elements 5 are arranged to be able to turn in the housing 2 of the electrical connecting device 1, they can be pivoted out of a first position (insertion position) into a second position (contact position). For the electrical connecting devices 1 shown in FIGS. 1, 2*a* & 3*a*, the actuating elements 5 are located in the insertion position, while in FIGS. 2*b* & 3*b* the actuating element 5 is shown in the contact position.

At this point, it is provided in accordance with the invention that the conductor receiver 7 in the actuating elements 5 is made such that at least two insulated conductors 3 can be inserted into the conductor receiver 7. The conductor receiver 7 has an oblong cross section so that the two insulated conductors 3 can be inserted in succession in the lengthwise direction L of the connecting device 1 into the conductor receiver 7.

In the embodiments as shown in FIGS. 2 & 4, the conductor receiver 7 has a roughly oval cross section, so that a conductor 3 which has been inserted into the conductor receiver 7 first is freely movable within the conductor receiver 7. In the embodiment as shown in FIGS. 3 & 5, the conductor receiver 7 has two guide channels 8, 9 which run parallel to one another, one for each insulated conductor 3.

The two guide channels 8, 9 are partially separated from one another by two ribs 10 which project into the conductor receiver 7.

As is especially apparent from FIG. 5, the two guide channels 8, 9 and the ribs 10 are made such that the two guide channels 8, 9 are connected to one another via a narrowed through region 11. The through region 11 has a width such that an insulated conductor 3 inserted into the guide channel 8 cannot extend into the guide channel 9 and vice versa. Furthermore, FIG. 5 shows that the two guide channels 8, 9 have different cross sections so that two insulated conductors 3 with different cross sections can be inserted into the two guide channels 8, 9.

Figure 6A:
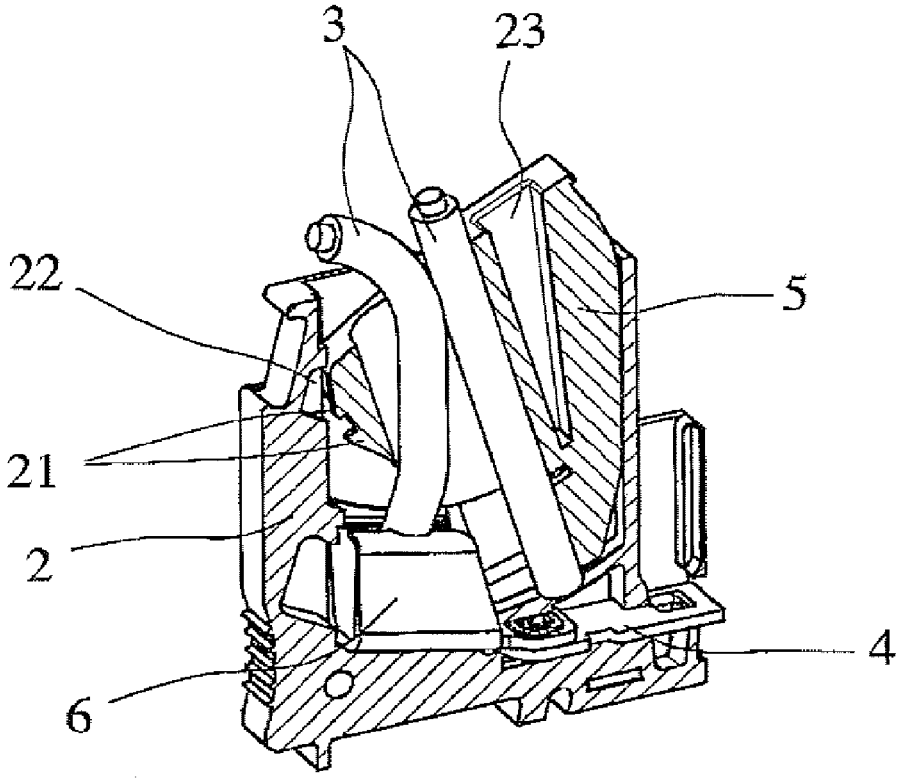
Figure 6B:
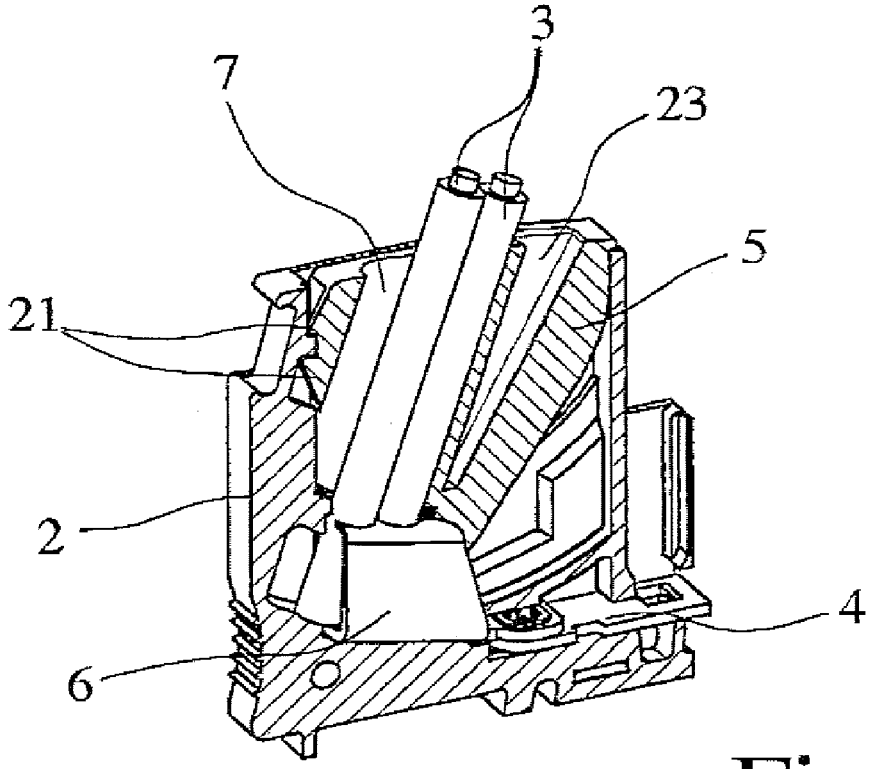

The actuating elements 5 shown in the figures enable both simultaneous insertion and connection of two insulated conductors 3, as is shown in FIGS. 2 & 3, as well as connection and deconnection of two insulated conductors 3 in succession in time. To do this, initially, a first insulated conductor 3 is inserted into the conductor receiver 7, preferably according to FIGS. 2 & 4, and then, the actuating element 5 is pivoted from the first position into the second position. In doing so, the electrical conductor 3 is moved within the conductor receiver 7 toward the front of the electrical connecting device 1. Then, the actuating element 5 is pivoted back again into the first position for connecting the second conductor 3 and the second conductor 3 is inserted into the conductor receiver 7—downstream of the first conductor 3—(compare FIG. 6*a*). Finally, the actuating element 5 is pivoted back into the second position, by which contact is also made with the second conductor 3 by the insulation piercing element 6 in addition to the first conductor 3 (compare FIG. 6*b*).

In the embodiments shown in the figures, the actuating elements 5 are each supported in the housing 2 of the electrical connecting device 1 by a journal 13 being formed on the side surface 12 of the actuating element 5 and being pivotally supported in a corresponding opening 14 in the side wall 15 of the housing.

In addition to the journal 13, on the side surfaces 12 of the actuating elements 5 there is an off-center locking journal 16 which is used to fix the actuating element 5 in the two end positions. To do this, in the side wall 15 of the housing 2, two corresponding catch openings 17 are formed which are connected to one another by a circular, arc-shaped slot 18. Since the width of the slot 18 is somewhat smaller than the diameter of the locking journal 16, unintentional pivoting of the actuating element 5 out of the first end position into the second end position or vice versa is prevented. However, at the same time, the expenditure of force for intentional pivot of the actuating element is relatively low since, due to the elasticity of the side wall 15 of the housing 2, the saddle 19 formed by the two catch openings 17 and the slot 18 can be bent slightly to the outside, by which the slot 18 acquires the necessary width to allow passage of the journal 16 from one opening 17 to the other.

In particular, it is apparent in FIGS. 4 & 5 that, on the front 20 of the actuating elements 5, two ribs 21 are formed which, together with a corresponding recess 22 within the housing 2, form an additional lock for the actuating element 5 in the second position.

Figure 2B:
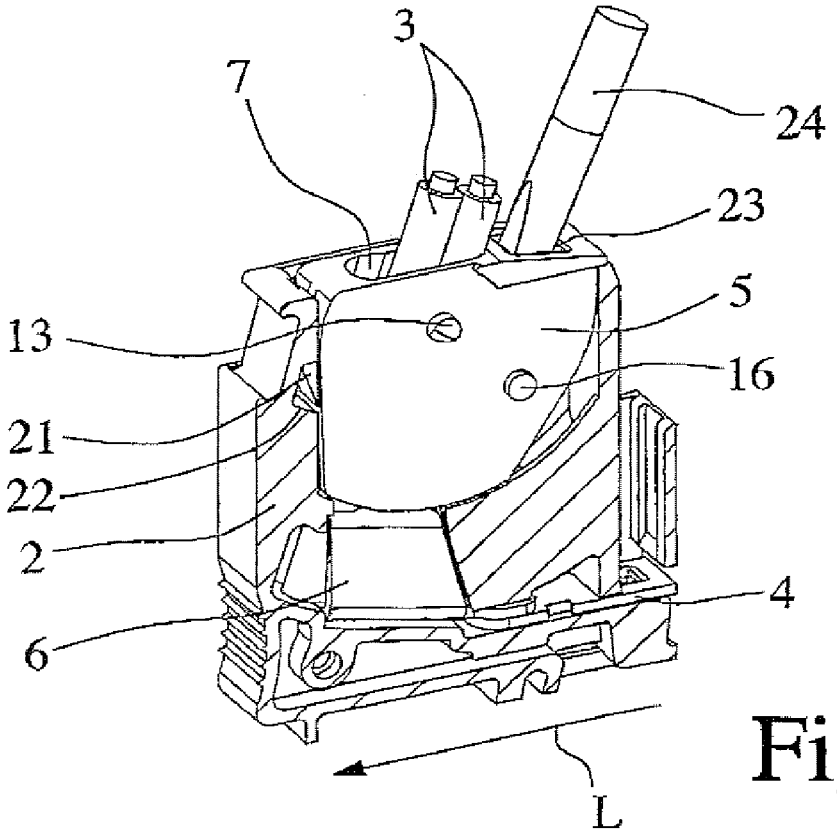

For easy handling, in the actuating elements 5, there is not only the conductor receiver 7, but, in addition, another receiver 23 for engaging a device, for example, the tip of a screwdriver 24. Using a screwdriver 24 which has been inserted into the receiver 23, the actuating element 5 can be easily moved out of the first position into the second position, and vice versa. To deconnect the electrical connecting device 1, i.e., for pivoting the actuating element 5 out of the second position (contact position) into the first position (insertion position), it can be advantageous if the screwdriver 24 is not inserted into the receiver 23—as is shown in FIG. 2*b*—but likewise into the conductor receiver 7—in front of the first conductor 3.

In the embodiment of the actuating element 5 as shown in FIG. 5, it is apparent that the conductor receiver 7 ends in a receiver pocket 25 which is located under the insulation piercing element 6. The receiver pocket 25 is used as a stop aid for the electrician when the conductor 3 is being inserted into the conductor receiver 7. When the end of the conductor 3 is inserted into the receiver pocket 25, it is ensured that when the actuating element 5 pivots into the contact position, the conductor 3 is properly grasped by the insulation piercing element 6, and thus, contact is made electrically with the core of the conductor 3.

Finally, FIG. 1 shows that the actuating elements 5 are made and arranged in the housing 2 such that it is easily possible to optically distinguish the insertion position from the contact position. In the insertion position, the upper edge 26 extends distinctly beyond the top edge of the housing 2. In contrast, in the contact position of the actuating element 5 shown in FIGS. 2*b* & 3*b*, the top edge 20 is flush with the top edge of the housing 2. Thus, the electrician can also visually recognize the respective position of the actuating element 5 with ease.

What is claimed is:

1. Electrical connecting device, comprising a housing with terminals for insulated conductors, with at least one conductor bar, with at least two actuating elements and with at least two insulation piercing elements, the actuating elements being arranged to be able to turn relative to the insulation piercing elements in the electrical connecting device and each having a conductor receiver for the conductors to be connected, the insulation piercing elements establishing electrical contact of conductors which have been inserted into the conductor receiver relative to the at least one conductor bar, wherein the actuating element is pivotable between a first position in which the conductors are insertable into the conductor receiver and a second position in which said electrical contact is established between the conductors and the at least one conductor bar, and wherein each of the conductor receivers in the actuating elements is sized and shaped for receiving at least two insulated conductors therein; wherein the insulation piercing elements in the electrical connecting device of each conductor receiver are located a first side thereof and wherein the actuating element has a planar surface bordering an opposite second side of each conductor receiver such that insulated conductors are insertable into the conductor receiver between the planar surface of the actuating element and the insulation piercing elements and are displaceable both jointly and sequentially into the piercing elements by pivoting of the actuating element from the first position to the second position, the actuating element being movable from the second position back to the first position without disengaging the insulated conductor or conductors engaged with the insulation piercing elements.

2. Electrical connecting device in accordance with claim 1, wherein the conductor receiver is sized and shaped for enabling the at least two insulated conductors to be inserted in succession into the conductor receiver in a lengthwise direction of the connecting device.

3. Electrical connecting device in accordance with claim 1, wherein the conductor receiver has an oblong cross section.

4. Electrical connecting device in accordance with claim 3, wherein the conductor receiver has two guide channels which run parallel to one another for receiving a respective insulated conductor, the two guide channels being at least partially separated from one another by at least one rib which projects into the conductor receiver.

5. Electrical connecting device in accordance with claim 4, wherein the two guide channels have different cross sections for connecting insulated conductors with different diameters.

6. Electrical connecting device in accordance with claim 1, wherein the actuating elements are pivotally supported by a journal on at least one side surface, the at least one journal being mounted in a corresponding opening in a side wall of the housing.

7. Electrical connecting device in accordance with claim 1, wherein the actuating elements are lockable in the first position in which the incoming conductors are insertable, and in the second position in which contact is made with the conductors by the insulation piercing element.

8. Electrical connecting device in accordance with claim 7, wherein on at least one side surface of the actuating elements, there is a locking journal that is located off-center and wherein two corresponding catch openings for the locking journal are located in a facing side wall of the housing, the two catch openings in the side wall of the housing being connected to one another by a slot.

9. Electrical connecting device in accordance with claim 8, wherein the slot runs in an arc and a width of the slot is smaller than a diameter of the locking journal.

10. Electrical connecting device in accordance with claim 1, wherein the actuating elements each have a receiver for engaging a tool receiver with which an inserted tool can move the electrical connecting device from the first position into the second position.

11. Electrical connecting device in accordance with claim 1, wherein the conductor receiver in the actuating elements is an oblong hole, the oblong hole ending in a receiver pocket which is located underneath the insulating piercing element.

12. Electrical connecting device in accordance with claim 1, wherein the actuating elements are located in the housing in a manner that enables the first position to be visually distinguished from the second position.

13. Electrical connecting device in accordance with claim 12, wherein the first position is visually distinguishable from the second position by a top edge of the actuating element projecting distinctly above a top edge of the housing in the first position but not in the second position.

14. Electrical connecting device in accordance with claim 1, wherein the conductor receiver has two guide channels which run parallel to one another, each of which receives a respective insulated conductor, wherein the two guide channels are at least partially separated from one another by at least one rib which projects into the conductor receiver, wherein the two guide channels have different cross sections for connecting insulated conductors of different diameters, and wherein the actuating elements each having a tool receiver with which an inserted tool can move the electrical connecting device from the first position into the second position.

* * * * *